US012085065B2

(12) United States Patent
Sikora et al.

(10) Patent No.: US 12,085,065 B2
(45) Date of Patent: Sep. 10, 2024

(54) PUMP COMPRISING BALLS FOR DISPLACEMENT OF FLUID

(71) Applicant: Golden Bear LLC, Columbus, OH (US)

(72) Inventors: Joshua Robert Sikora, Columbus, OH (US); Charles Russell Patzer, Columbus, OH (US); Jack Louis Kime, Columbus, OH (US)

(73) Assignee: Golden Bear LLC, Columbus, OH (US)

( * ) Notice: Subject to any disclaimer, the term of this patent is extended or adjusted under 35 U.S.C. 154(b) by 229 days.

(21) Appl. No.: 17/506,595

(22) Filed: Oct. 20, 2021

(65) Prior Publication Data

US 2022/0119140 A1 Apr. 21, 2022

Related U.S. Application Data

(60) Provisional application No. 63/094,296, filed on Oct. 20, 2020.

(51) Int. Cl.
*F04B 1/0408* (2020.01)
*F04B 1/0413* (2020.01)
(Continued)

(52) U.S. Cl.
CPC ..... *F04B 1/0408* (2013.01); *F04B 1/0413* (2013.01); *F04B 1/0426* (2013.01); *F04B 1/0531* (2013.01); *F04B 9/042* (2013.01)

(58) Field of Classification Search
CPC .... F04B 1/0408; F04B 1/0413; F04B 1/0426; F04B 1/0531; F04B 9/042; F04B 9/04
See application file for complete search history.

(56) References Cited

U.S. PATENT DOCUMENTS 459,735 A * 9/1891 Benham ..... F04B 1/22 92/172
2,289,865 A 7/1942 Benedek
(Continued)

FOREIGN PATENT DOCUMENTS

EP 0778418 A1 11/1997
EP 3272659 A1 1/2018
GB 2038761 A 7/1980

OTHER PUBLICATIONS

PCT Form 210, International Search Report for PCT/US2021/055919, mailed on Feb. 28, 2022.
(Continued)

*Primary Examiner* — Bryan M Lettman
(74) *Attorney, Agent, or Firm* — The Law Office of Patrick F. O'Reilly III, LLC

(57) ABSTRACT

A strapping tool and a pump used thereby are disclosed herein. The strapping tool includes a battery-powered motor; a hydraulic assembly operatively coupled to the battery-powered motor; and a sealing assembly, the sealing assembly comprising at least one crimping jaw member, the hydraulic assembly operatively coupling the at least one crimping jaw member to the battery-powered motor, and the at least one crimping jaw member of the sealing assembly configured to crimp or notch a strapping seal member so as to secure a piece of strapping around a package or bundle of items. The pump includes a pump rotor; and a plurality of balls displaced by the pump rotor, the plurality of balls configured to displace a fluid in the pump. The pump contains no linkage members and no piston.

10 Claims, 15 Drawing Sheets

(51) Int. Cl.

| | |
|---|---|
| ***F04B 1/0426*** | (2020.01) |
| ***F04B 1/0531*** | (2020.01) |
| ***F04B 9/04*** | (2006.01) |

(56) References Cited

U.S. PATENT DOCUMENTS

| | | | | |
|---|---|---|---|---|
| 2,289,866 | A | | 7/1942 | Benedek |
| 2,386,153 | A | | 10/1945 | Watt et al. |
| 2,452,541 | A | | 11/1948 | Benedek |
| 2,463,486 | A | * | 3/1949 | Johnson ..... F04B 1/0408 417/205 |
| 2,800,857 | A | | 7/1957 | Julius |
| 3,144,888 | A | | 8/1964 | Palmer |
| 3,223,046 | A | | 12/1965 | Karl |
| 3,329,178 | A | | 7/1967 | Plunkett |
| 3,333,608 | A | | 8/1967 | Xaver |
| 3,530,809 | A | | 9/1970 | Porter |
| 3,552,450 | A | | 1/1971 | Plunkett |
| 3,654,033 | A | | 4/1972 | Angarola et al. |
| 3,664,772 | A | * | 5/1972 | Panariti ..... F04B 1/16 91/472 |
| 3,799,835 | A | | 3/1974 | Gilmore |
| 3,899,958 | A | | 8/1975 | Spencer |
| 3,913,455 | A | | 10/1975 | Green et al. |
| 4,027,609 | A | | 6/1977 | Kerr |
| 4,096,019 | A | | 6/1978 | Lehmann |
| 4,166,422 | A | | 9/1979 | Porter |
| 4,412,498 | A | | 11/1983 | Scholl |
| 4,449,464 | A | | 5/1984 | Porter |
| 4,704,948 | A | | 11/1987 | Wusthof et al. |
| 4,871,414 | A | | 10/1989 | Niedrig |
| 5,090,295 | A | | 2/1992 | Cunningham et al. |
| 5,179,889 | A | | 1/1993 | Wusthof et al. |
| 5,391,059 | A | | 2/1995 | Hallund |
| 5,476,569 | A | | 12/1995 | Harada |
| 5,526,761 | A | | 6/1996 | Mulcahey et al. |
| 5,601,417 | A | * | 2/1997 | Haluda ..... F04B 3/00 417/269 |
| 5,632,851 | A | | 5/1997 | Young |
| 5,653,095 | A | | 8/1997 | Stamm |
| 5,942,061 | A | | 8/1999 | Figiel et al. |
| 5,954,899 | A | | 9/1999 | Figiel et al. |
| 6,308,760 | B1 | | 10/2001 | Finzo et al. |
| 6,328,087 | B1 | | 12/2001 | Finzo et al. |
| 6,332,306 | B1 | | 12/2001 | Finzo et al. |
| 6,764,285 | B1 | | 7/2004 | Kellner |
| 6,895,733 | B2 | | 5/2005 | Nix |
| 6,957,678 | B2 | | 10/2005 | Scholl et al. |
| 6,966,255 | B1 | | 11/2005 | Crittenden |
| 7,073,431 | B1 | | 7/2006 | Chen |
| 7,428,866 | B2 | | 9/2008 | Reiche |
| 8,176,838 | B2 | | 5/2012 | Walker |
| 8,578,997 | B2 | | 11/2013 | Rauch |
| 9,789,984 | B2 | | 10/2017 | Sikora et al. |
| 10,745,158 | B2 | | 8/2020 | Sikora et al. |
| 10,793,303 | B2 | | 10/2020 | Sikora et al. |
| 11,130,598 | B2 | | 9/2021 | Sikora et al. |
| 11,560,247 | B2 | | 1/2023 | Sikora et al. |
| 2009/0013656 | A1 | | 1/2009 | Nasiatka et al. |
| 2011/0056392 | A1 | | 3/2011 | Neeser et al. |
| 2011/0083596 | A1 | | 4/2011 | Asao et al. |
| 2012/0060735 | A1 | | 3/2012 | Dickerson |
| 2012/0085274 | A1 | | 4/2012 | Bardh et al. |
| 2012/0210682 | A1 | | 8/2012 | Gardner et al. |
| 2013/0085053 | A1 | | 4/2013 | Figiel et al. |
| 2014/0007781 | A1 | | 1/2014 | Sikora et al. |
| 2014/0083311 | A1 | | 3/2014 | Bonifazi et al. |
| 2014/0290179 | A1 | | 10/2014 | Keller |
| 2015/0210411 | A1 | | 7/2015 | Finzo et al. |
| 2015/0270690 | A1 | | 9/2015 | Yamamoto et al. |
| 2015/0321777 | A1 | | 11/2015 | Nasiatka et al. |
| 2016/0016682 | A1 | | 1/2016 | Boss et al. |
| 2016/0107775 | A1 | | 4/2016 | Amacker et al. |
| 2016/0167814 | A1 | | 6/2016 | Figiel et al. |
| 2017/0008652 | A1 | | 1/2017 | Figiel et al. |
| 2017/0166335 | A1 | | 6/2017 | Nasiatka et al. |
| 2017/0174374 | A1 | | 6/2017 | Figiel et al. |
| 2018/0037347 | A1 | | 2/2018 | Sikora et al. |
| 2018/0127124 | A1 | | 5/2018 | Sikora et al. |

OTHER PUBLICATIONS

PCT Form 237, Written Opinion of the International Searching Authority for PCT/US2021/055919, mailed on Feb. 28, 2022.

* cited by examiner

SECTION A-A

PUMP COMPRISING BALLS FOR DISPLACEMENT OF FLUID

CROSS-REFERENCE TO RELATED APPLICATIONS

This patent application claims priority to, and incorporates by reference in its entirety, U.S. Provisional Patent Application No. 63/094,296, entitled "Strapping Tool", filed on Oct. 20, 2020.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a strapping tool. More particularly, the invention relates to a strapping tool that is configured to a notch or crimp a strapping seal member that secures end portions of the piece of strapping to one another.

2. Background

Various tools are known in the packaging art for performing numerous functions related to the manipulation of strapping, which is commonly used as a closing mechanism for packages, and as a convenient means for easily attaching two objects to one another (e.g., attaching a box to a pallet). Some of these conventional tools are powered directly from a centralized system, such as a building electrical system or a central pneumatic system. That is, conventional tools of this type usually require power sources that are not an integrated part of the unit (e.g., for a pneumatic tool, a remote air compressor is required). The aforementioned types of conventional packaging tools have numerous limitations and drawbacks. For example, these conventional tools are not able to be used where a power source is unavailable. Also, these conventional tools are often overly heavy and cumbersome to use.

Therefore, what is needed is a strapping tool that is convenient for virtually any application where other power sources are unavailable. Moreover, there is a need for a strapping tool that utilizes hydraulics so as to result in a tool that is both lightweight and very powerful. Furthermore, there is a need for a strapping tool that, by virtue of being hydraulic, includes many moving parts that are self-lubricated.

BRIEF SUMMARY OF EMBODIMENTS OF THE INVENTION

Accordingly, the present invention is directed to a strapping tool that substantially obviates one or more problems resulting from the limitations and deficiencies of the related art.

In accordance with one or more embodiments of the present invention, there is provided a strapping tool. The strapping tool includes a battery-powered motor; a hydraulic assembly operatively coupled to the battery-powered motor; and a sealing assembly, the sealing assembly comprising at least one crimping jaw member, the hydraulic assembly operatively coupling the at least one crimping jaw member to the battery-powered motor, and the at least one crimping jaw member of the sealing assembly configured to crimp or notch a strapping seal member so as to secure a piece of strapping around a package or bundle of items.

In a further embodiment of the present invention, the hydraulic assembly comprises a piston-less ball pump.

In yet a further embodiment, the piston-less ball pump of the hydraulic assembly comprises high-precision bearing balls that operate as a motion linkage between a fluid being pumped and a rotating shaft.

In still a further embodiment, the hydraulic assembly comprises a single manifold block that includes a directional valve, hydraulic cylinder, and relief valve.

In yet a further embodiment, the hydraulic assembly comprises a spring-loaded hydraulic tank with an isolation piston that allows the strapping tool to be used in a plurality of different orientations.

In accordance with one or more other embodiments of the present invention, there is provided a strapping tool. The strapping tool includes a battery-powered motor; a hydraulic assembly operatively coupled to the battery-powered motor; and a strapping tool assembly operatively coupled to the hydraulic assembly, the strapping tool assembly configured to perform one or more strapping operations, said one or more strapping operations performed by said strapping tool assembly including sealing or tensioning plastic, steel, or cord strappings.

In accordance with yet one or more other embodiments of the present invention, there is provided a pump. The pump includes a pump rotor; and a plurality of balls displaced by the pump rotor, the plurality of balls configured to displace a fluid in the pump. In these one or more embodiments, the pump contains no linkage members and no piston.

In a further embodiment of the present invention, the plurality of balls displaced by the pump rotor include two balls in series that are displaced by the pump rotor; and the pump further comprises a sleeve for tightly receiving the two balls, the two balls resulting in less leakage than a single ball.

In yet a further embodiment, the pump rotor comprises at least one parabolic indentation that engages one or more balls of the plurality of balls, the pump rotor pushing the plurality of balls outwardly from a center of the pump; and the pump comprises a spring for creating a fluid force that returns the plurality of balls inwardly towards the center of the pump.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
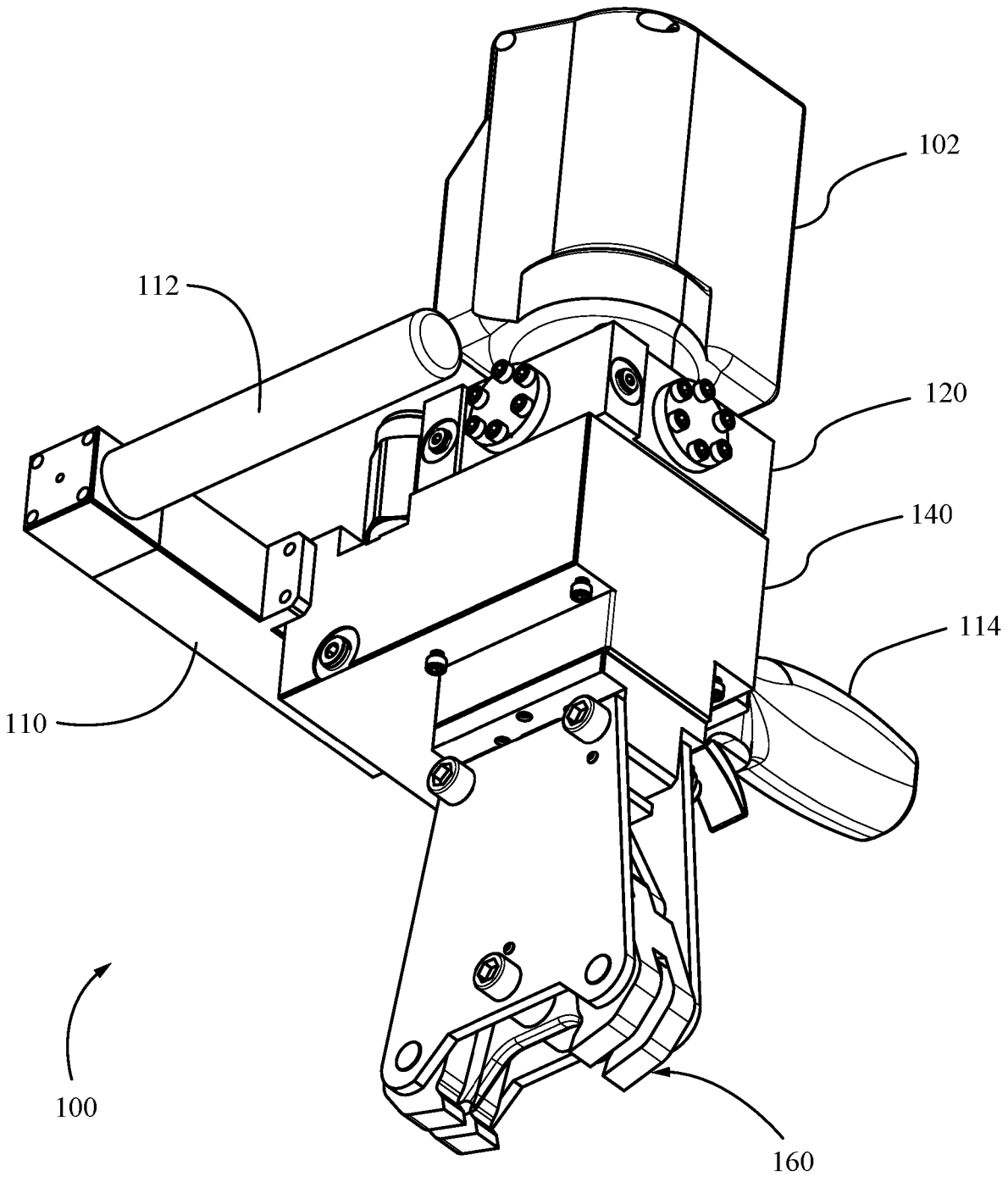
FIG. 1 is a first side perspective view of a strapping tool, according to an illustrative embodiment of the invention.
Figure 2:
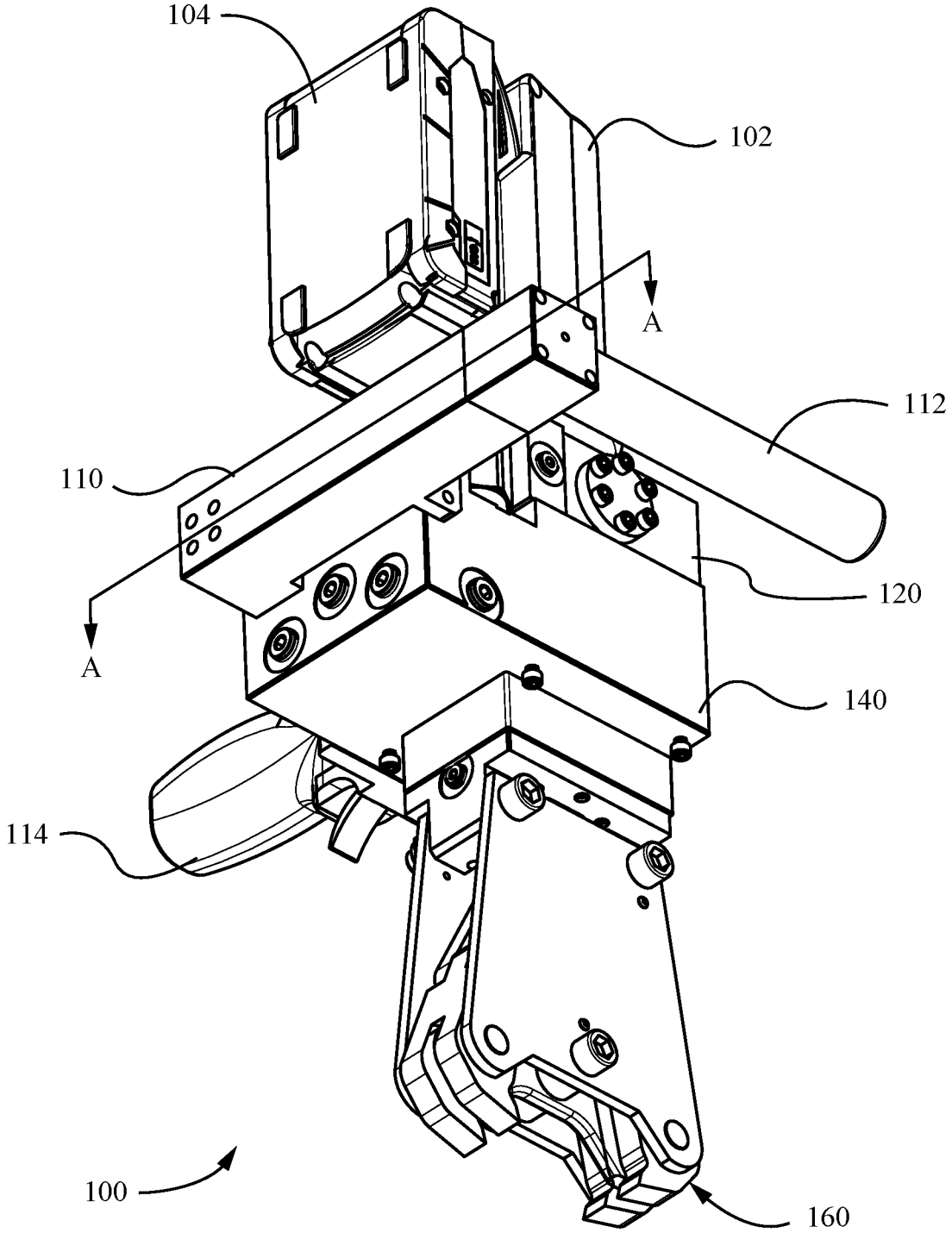
FIG. 2 is a second side perspective view of the strapping tool of FIG. 1.
Figure 3:
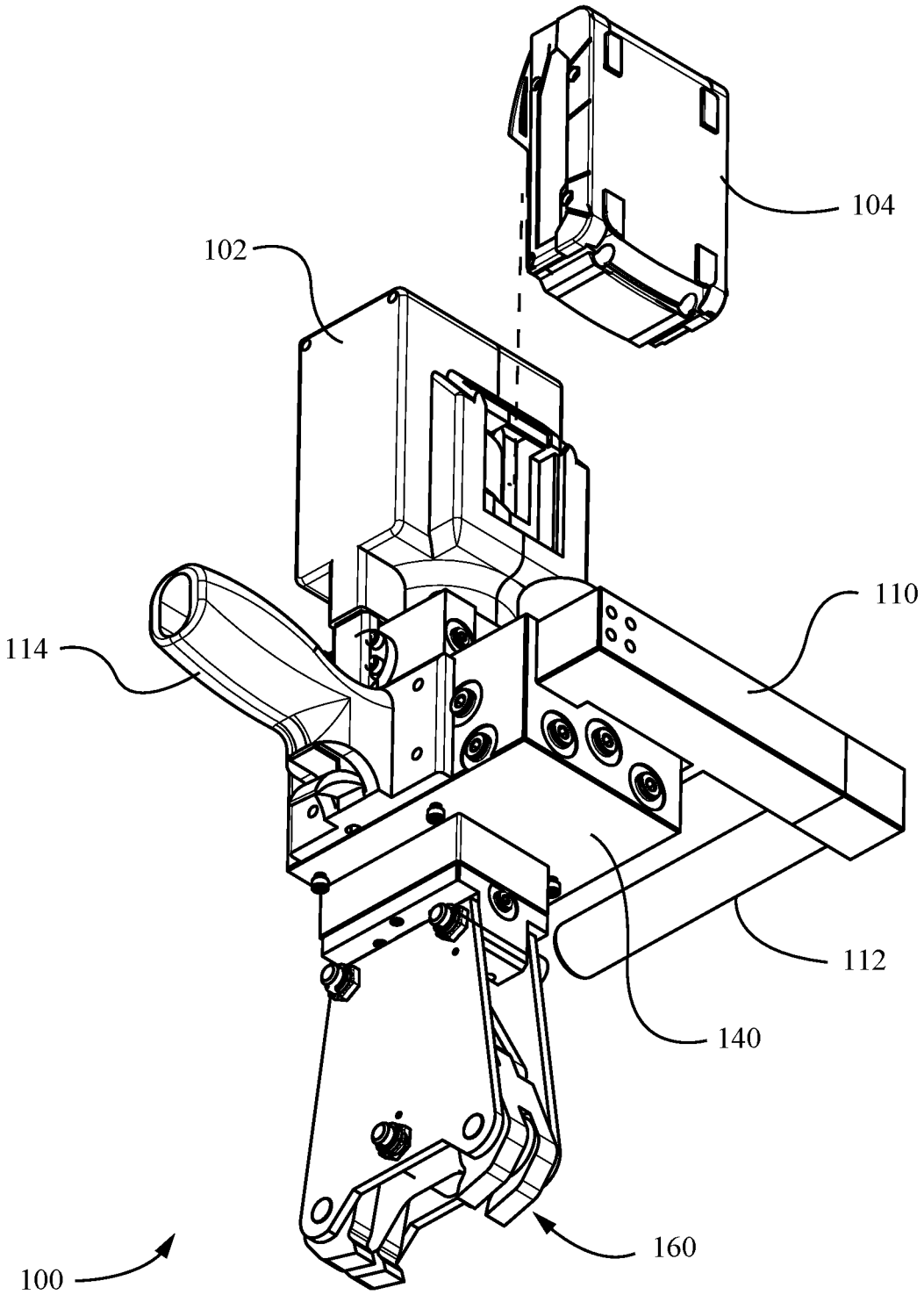
FIG. 3 is a third side perspective view of the strapping tool of FIG. 1, wherein the battery pack is shown detached from the strapping tool.
Figure 4:
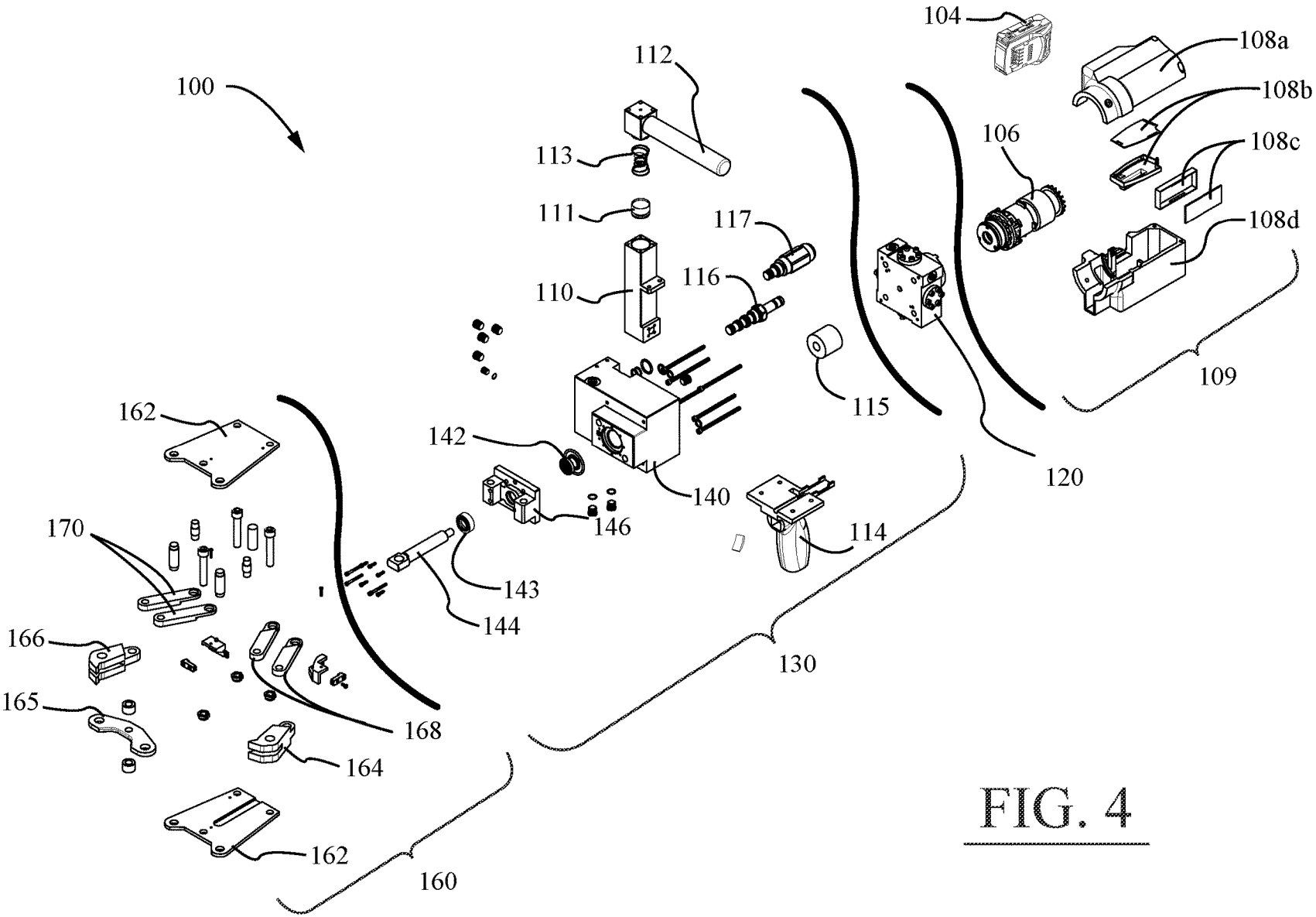
FIG. 4 is an exploded perspective view of the strapping tool of FIG. 1.

An illustrative embodiment of the strapping tool is seen generally at 100 in FIGS. 1-3. An exploded perspective view of the assemblies that form the strapping tool 100 is depicted in FIG. 4. Initially with reference to the illustrative embodiment of FIG. 4, it can be seen that the strapping tool 100 generally comprises a battery-powered motor assembly 109, a hydraulic assembly 130 operatively coupled to the battery-powered motor assembly 109; and a sealing assembly 160 operatively coupled to the hydraulic assembly 130, and configured to crimp or notch a strapping seal member so as to secure a piece of strapping with strapping portions around a package or bundle of items.

While the sealing assembly 160 of the strapping tool 100 crimps or notches the strapping seal member in the illustrative embodiment, it is to be understood that, in other embodiments, the sealing assembly 160 of the strapping tool 100 may punch the seal member rather than crimp or notch the seal member.

Figure 6:
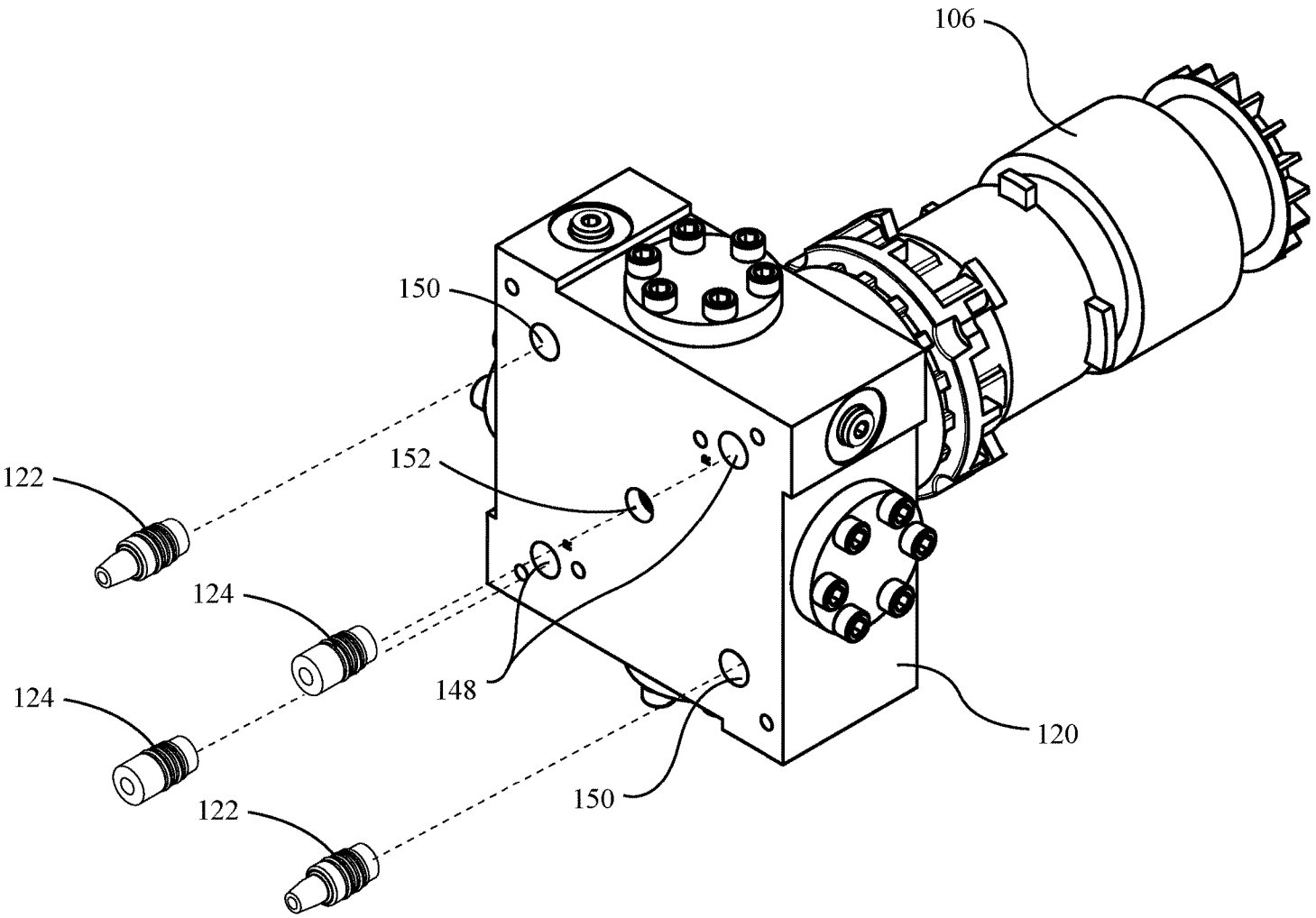
FIG. 6 is a perspective view of the motor and pump of the hydraulic assembly of the strapping tool of FIG. 1.

Referring again to FIGS. 4 and 6, in the illustrative embodiment, the motor 106 supplies power to the sealing assembly 160 via the hydraulic assembly 130.

In the illustrative embodiment, the motive power source is in the form of electric motor 106 powered by the removable battery pack 104. However, in other embodiments, other types of motive power sources may be used.

Now, referring primarily to the exploded view of FIG. 4, the components of the hydraulic assembly 130 will be described. As shown in FIG. 4, the hydraulic assembly 130 includes a tank body 110 for holding hydraulic fluid (i.e., a non-compressible oil) in a reservoir 118, a reservoir piston 111, a compression spring 113 that exerts a spring force on the reservoir piston 111 to pressurize tank 110, and tank handle 112. Advantageously, the spring-loaded hydraulic tank 110 with piston 111 allows the strapping tool 100 to be used in a plurality of different orientations because the tool 100 is not dependent on gravity. Also, in FIG. 4, it can be seen that the hydraulic assembly 130 further includes a magnetic valve coil 115, a solenoid directional valve 116 actuated by magnetic valve coil 115 when the coil 115 is energized, a pressure relief valve 117 (e.g., to limit fluid pressure to 2,300 psi), and a pump 120. In addition, with reference again to FIG. 4, the hydraulic assembly 130 also includes a valve cycle block 140, a cylinder shaft wear ring 142, a main piston 143, a cylinder rod 144, and a cylinder cap 146. The main piston 143 is disposed on the top of the cylinder rod 144 (see FIGS. 10 and 11).

Next, with reference primarily to the exploded view of FIG. 4, the sealing assembly 160 of the illustrative strapping tool 100 will be described in detail. In the illustrative embodiment, referring to FIG. 4, it can be seen that the sealing assembly 160 generally includes a plurality of linkage members 168, 170 and a plurality of sealing jaw members 164, 166. As shown in FIG. 4, it can be seen that the sealing jaw members 164, 166 each comprise respective sealing teeth for forming the notched portions in a seal member. The linkage members 168, 170 connect the sealing jaw members 164, 166 to the cylinder rod 144. In the illustrative embodiment, the components 144, 164, 166, 168, 170 are connected to one another by a plurality of pin members.

Referring again to FIG. 4, it can be seen that the sealing jaw members 164, 166 are connected together by means of a center notcher plate 165. Jaw pivot pins extend in the front-to-back direction of the strapping tool 100, and pass through apertures in the sealing jaw members 164, 166 and spaced-apart apertures in the center notcher plate 165 so as to couple the sealing jaw members 164, 166 to the center notcher plate 165. The sealing jaw member 164 disposed on the first side of the strapping tool 100 pivots about a first jaw pivot pin during the notching of the seal member, while the sealing jaw member 166 disposed on the second side of the strapping tool 100 pivots about a second jaw pivot pin during the notching of the seal member.

Figure 5:
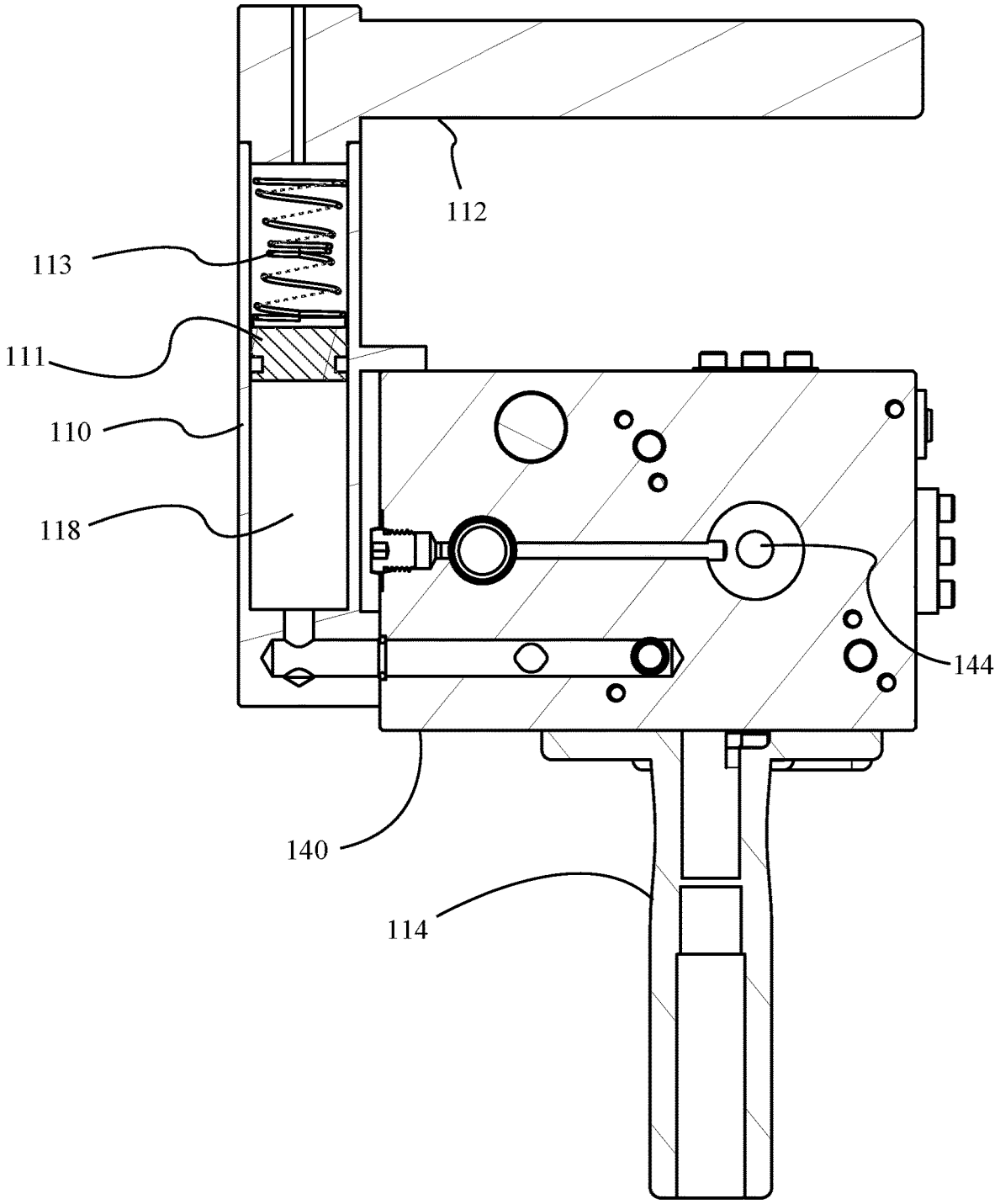
FIG. 5 is a sectional view cut through the hydraulic assembly of the strapping tool of FIG. 1, which is cut along the cutting-plane line A-A in FIG. 2.
Figure 7:
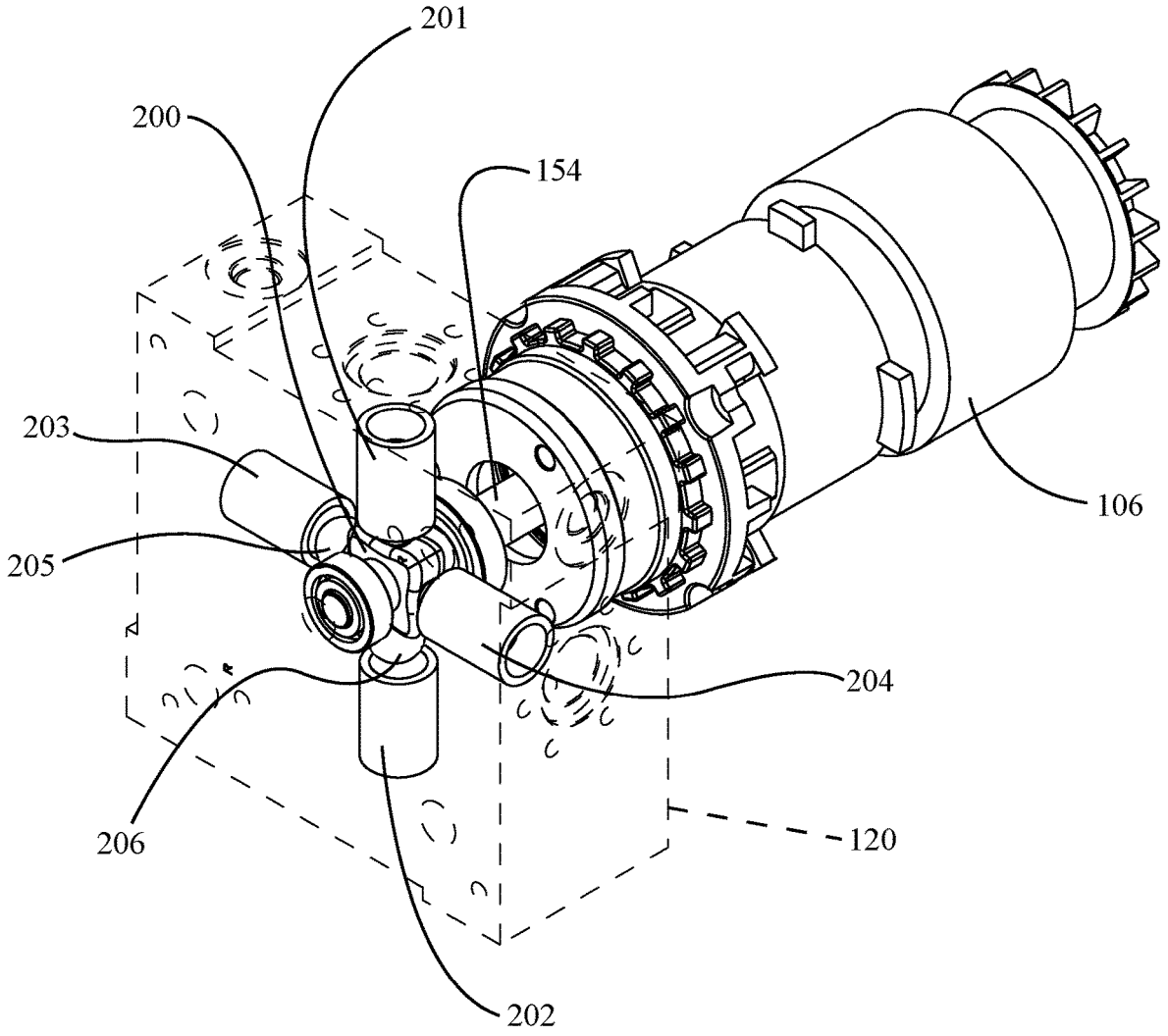
FIG. 7 is another perspective view of the motor and pump of the hydraulic assembly of the strapping tool of FIG. 1, wherein internal components of the pump are illustrated.
Figure 8:
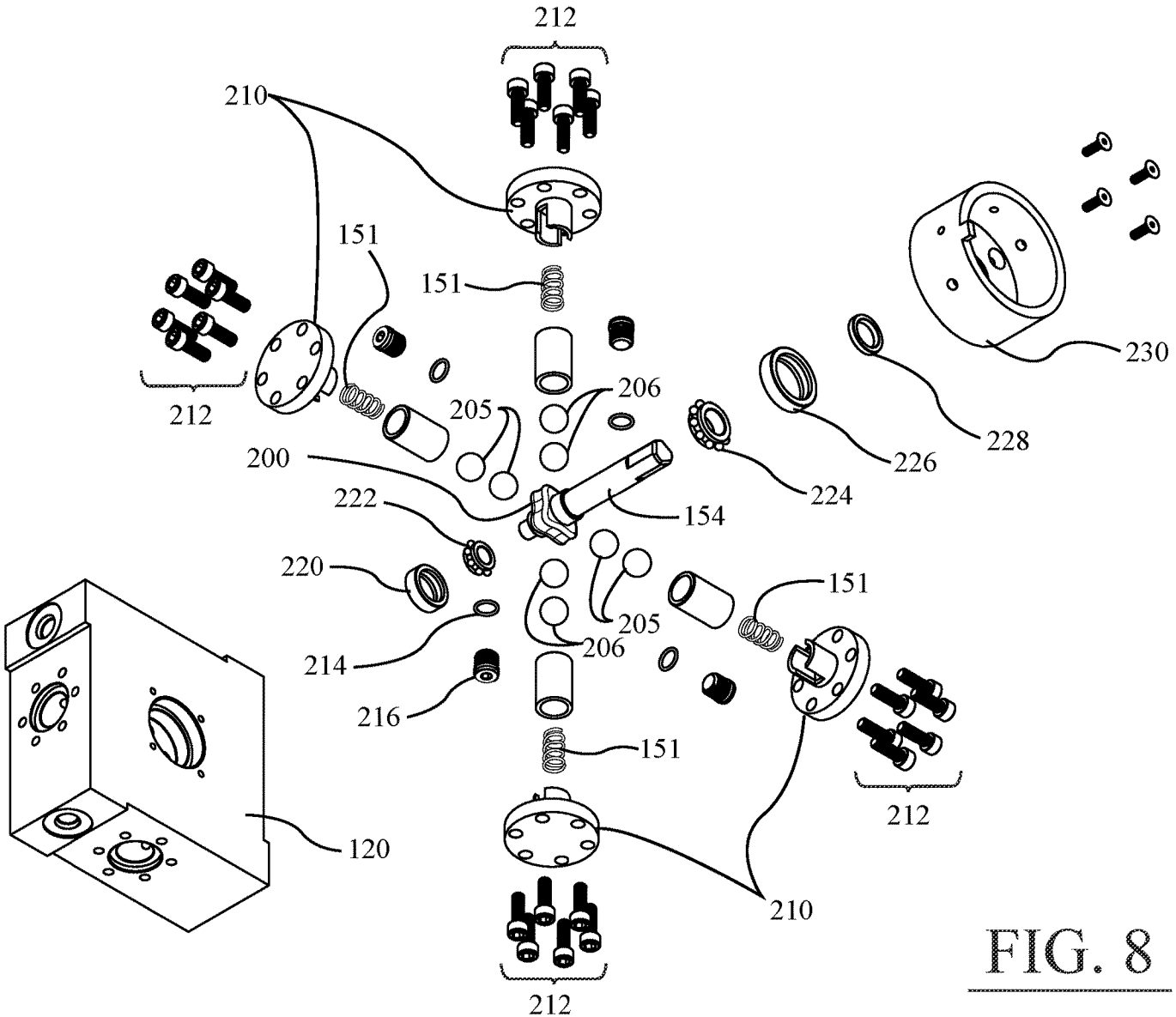
FIG. 8 is an exploded perspective view of the pump of the hydraulic assembly of the strapping tool of FIG. 1.

Now, the functionality of the hydraulic system of the strapping tool 100 will be described. When activated, motor 106 creates fluid flow by rotating the pump rotor 200 (see FIGS. 9*a*-9*d*) which pushes the eight (8) balls 205, 206 outwardly from a pump center, and inside four (4) pumping chambers formed by sleeves or press-fit drill bushings 201, 202, 203, 204 (see FIG. 7). Each outward stroke of the balls 205, 206 creates fluid flow by forcing oil through outlet check valves 124 (see FIG. 6). And each inward stroke of the balls 205, 206 accepts oil from the tank 110 (see FIG. 5) through inlet check valves 122 (see FIG. 6). As shown in FIGS. 8 and 9*a*-9*d*, the pump 120 comprises a plurality of springs 151 for returning the plurality of balls 205, 206 inwardly towards the center of the pump 120. The outflow through the outlet check valves 124 enters the manifold or cylinder block 140 which integrates a directional valve 116 and a relief valve 117 (see FIGS. 10 and 11). At the beginning of the cycle, the oil passes through the directional valve 116 and forces cylinder rod 144 to extend (e.g., a force of approximately 1,500 lbs. is exerted on rod 144 by hydraulic system). At this point a time delay begins to allow full extension of the cylinder rod 144 to take place. When this time delay is complete, the directional valve 116 is activated, and then directs oil to reverse the cylinder rod 144 causing it to retract. At this point, another time delay starts to allow time for the cylinder rod 144 to retract completely. When the second time delay completes, the cycle is over and the tool 100 is ready to run a new cycle. At any time in the cycle if a set pressure is reached, oil flows through the relief valve 117 and returns to the tank limiting pressure inside the cylinder block 140.

Figure 9A:
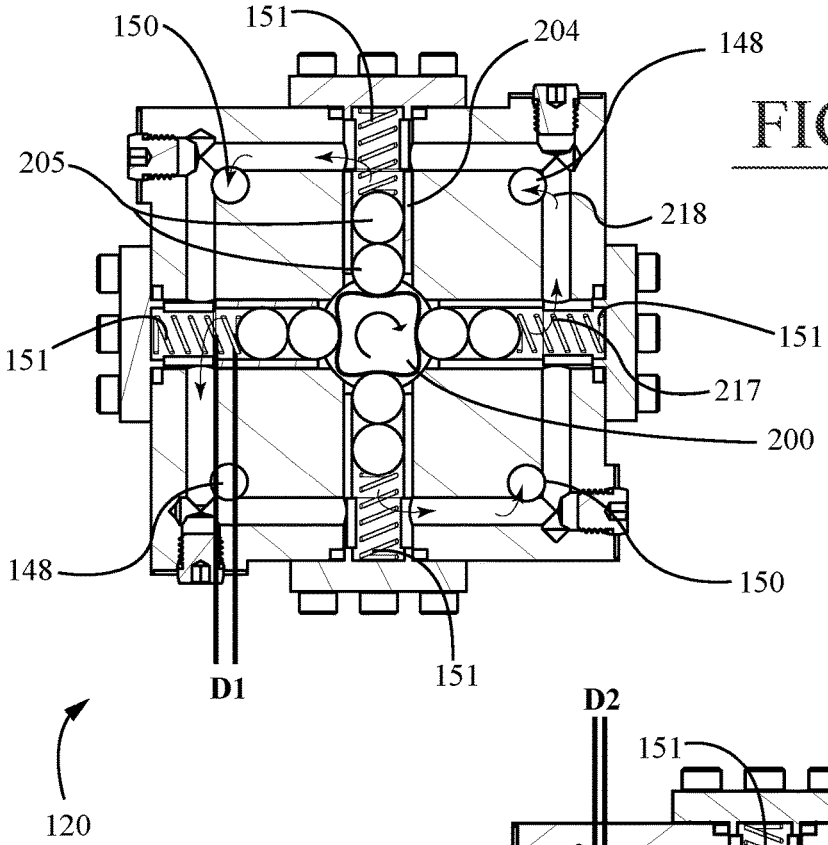
FIG. 9*a* is a sectional view cut through the pump of the hydraulic assembly of the strapping tool of FIG. 1, wherein a first operational state of the pump is shown.
Figure 9B:
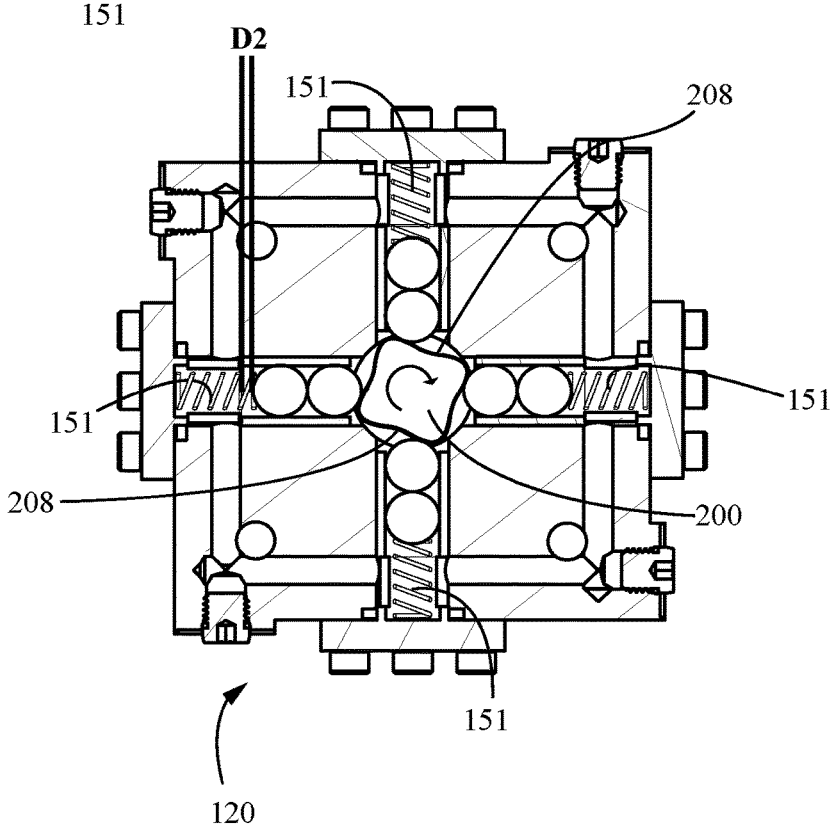
FIG. 9*b* is another sectional view of the pump similar to the sectional view of FIG. 9*a*, wherein a second operational position of the pump is shown.
Figure 9C:
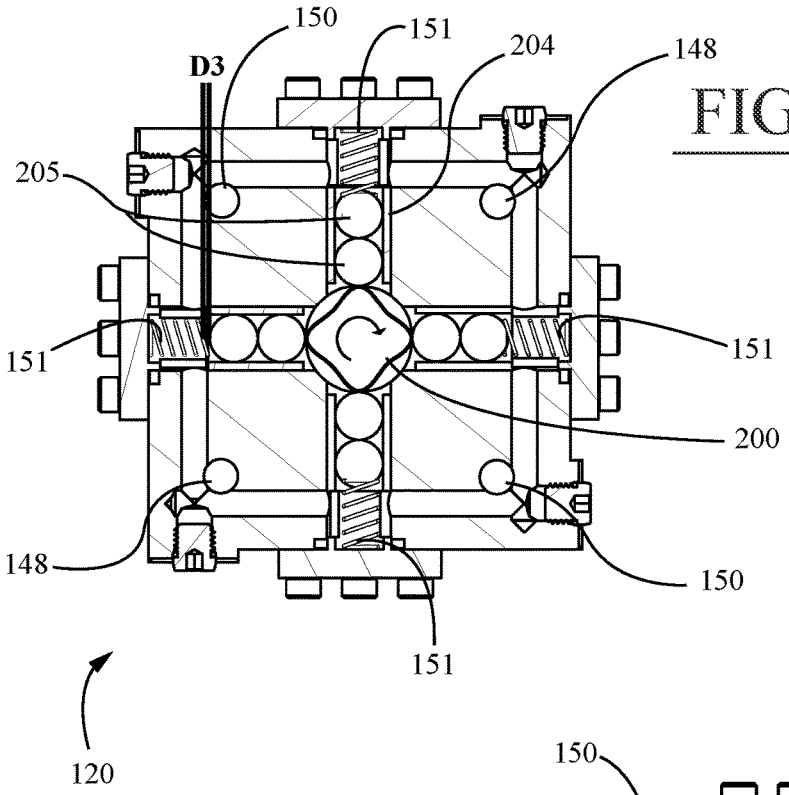
FIG. 9*c* is yet another sectional view of the pump similar to the sectional view of FIG. 9*a*, wherein a third operational position of the pump is shown.
Figure 9D:
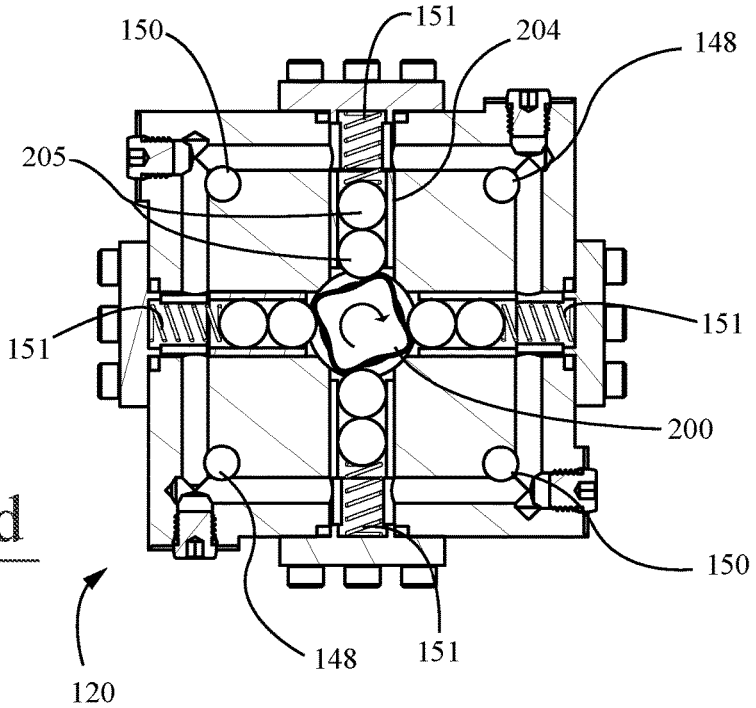
FIG. 9*d* is still another sectional view of the pump similar to the sectional view of FIG. 9*a*, wherein a fourth operational position of the pump is shown.

In FIGS. 9*a*-9*d*, the pump rotor 200 is shown spinning in a clockwise direction. Based on the shape of the pump rotor 200 with the parabolic indentations 208, the pump balls 205, 206 (e.g., ⅜" balls) are smoothly pushed down their respective sleeves 201, 202, 203, 204 as the rotor 200 spins. This in turn, pushes the hydraulic fluid (i.e., oil) down the shaft where it turns the corner through another passageway (as diagrammatically represented by curved arrow 217), and then is pushed into a hole (as diagrammatically represented by curved arrow 218). Through a complex series of drilled out passageways the hydraulic fluid (i.e., oil) pushed out of these shafts leads to the main piston 143 attached to the linkage members 168, 170 to move the crimping jaws 164, 166. In FIGS. 9*a*-9*c*, the distances D1-D3 diagrammatically represent that the balls 205, 206 are physically moving down the sleeves 201, 202, 203, 204 (e.g., a ⅛" stroke for ball displacement). The maximum displacement of the balls 205, 206 is represented in FIG. 9*c*. In FIG. 9*d*, the pump rotor 200 is shown continuing to rotate and starting to reset the cycle.

Figure 10:
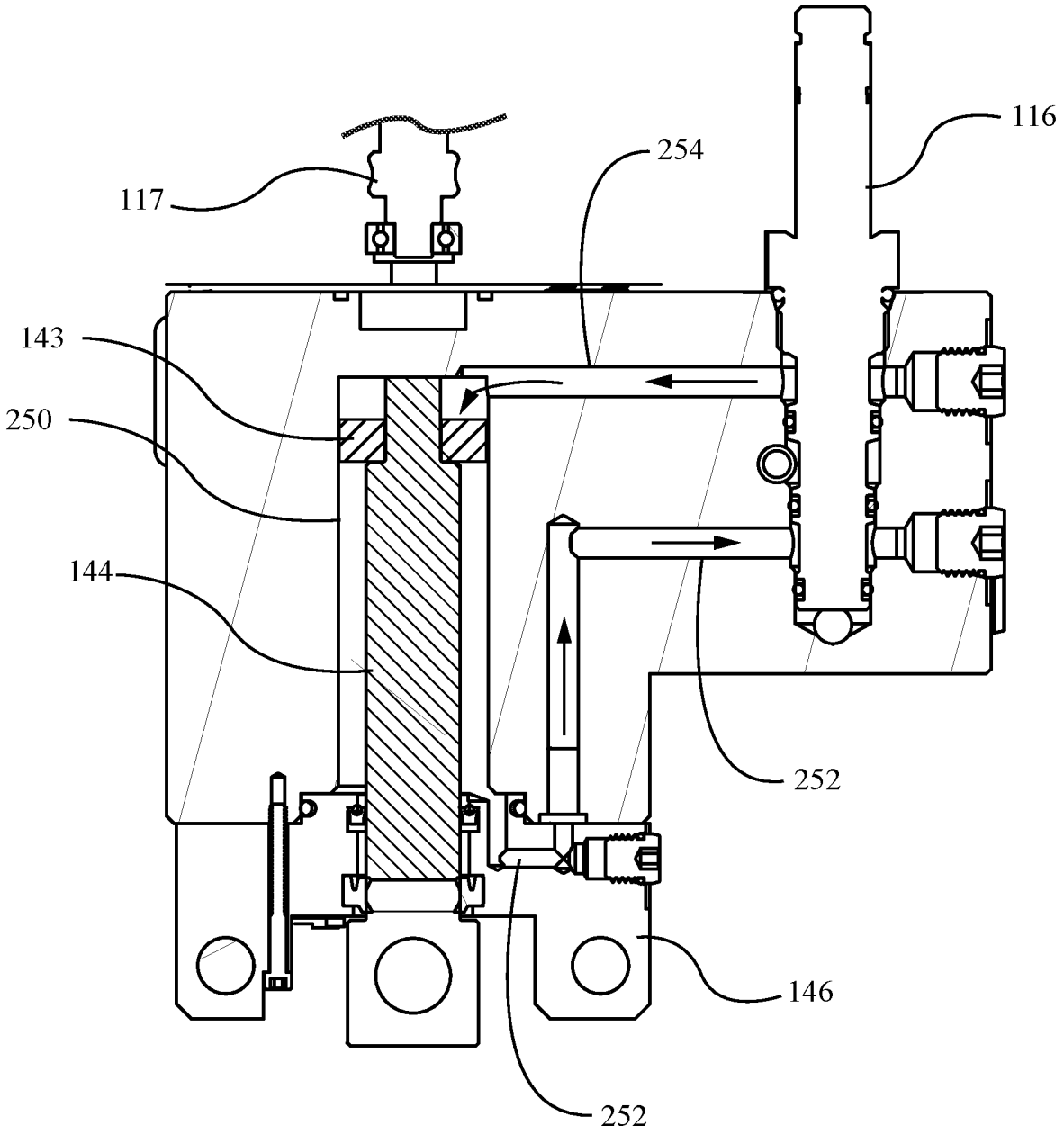
FIG. 10 is a sectional view cut through the manifold block of the hydraulic assembly of the strapping tool of FIG. 1, wherein a first operational state of the hydraulic system is shown.
Figure 11:
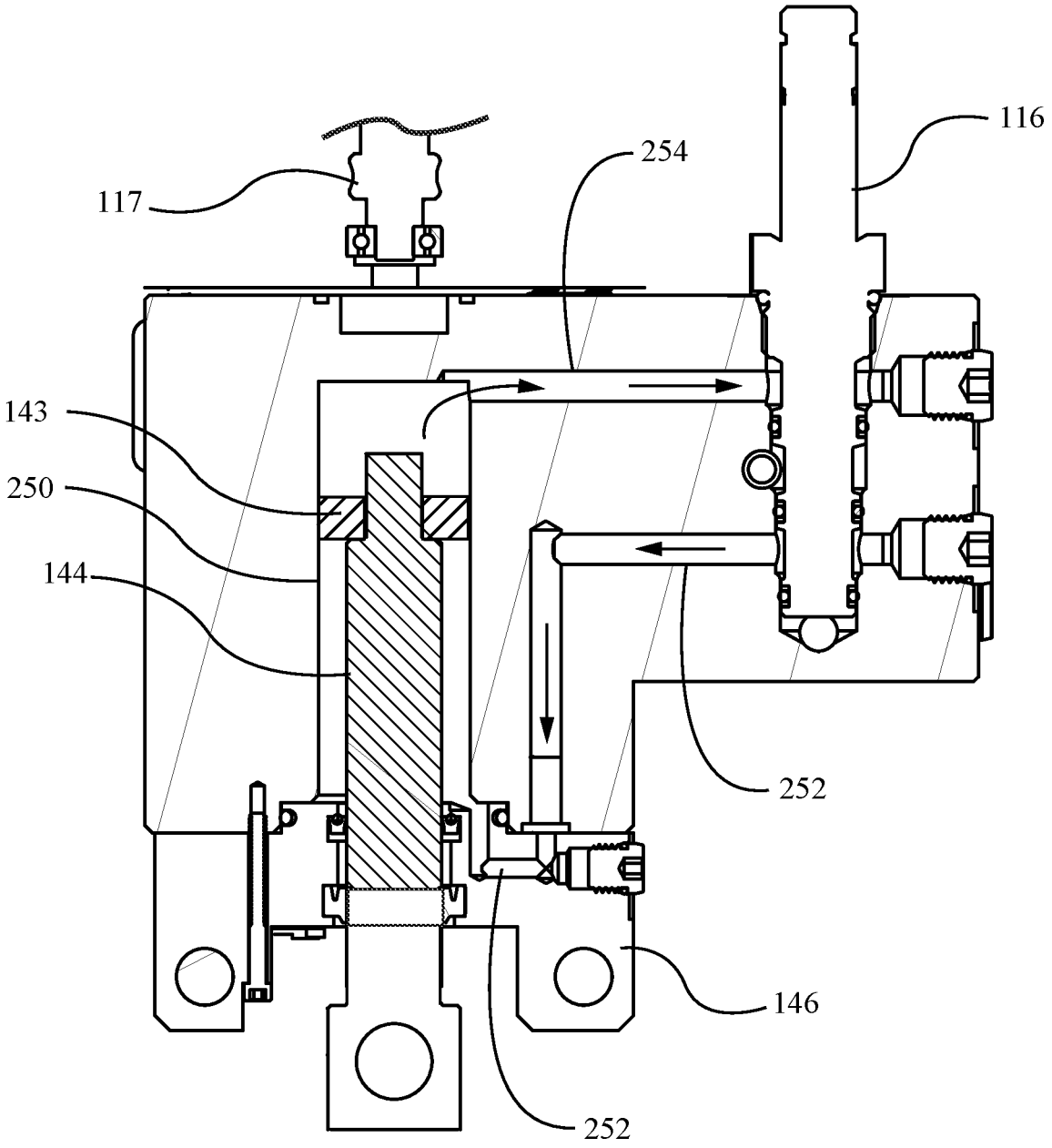
FIG. 11 is another sectional view of the manifold block similar to the sectional view of FIG. 10, wherein a second operational state of the hydraulic system is shown.

FIG. 10 illustrates the result of the pressurized fluid pushing out of the shafts in FIGS. 9*a*-9*d* leading to the main piston 143. Fluid moving through the solenoid directional valve 116 that passes through the whole system pushes the main piston 143 down, thereby moving the linkage members 168, 170 and the crimping jaws 164, 166. The solenoid directional valve 116 opens and closes to allow the hydraulic fluid to be stopped or allow flow to reverse. As denoted by the flow arrows, FIG. 11 illustrates a reversal of the flow from that which is depicted in FIG. 10. The solenoid is synced with sensors attached on the linkage members 168, 170 that instruct the tool 100 once the crimp is done, and to reverse the fluid flow back through the solenoid 116.

In the illustrative embodiment, the strapping tool 100 further comprises a control system operatively coupled to the electric motor 106 for controlling the operation of the sealing assembly 160. As shown in FIG. 4, the control system of the illustrative strapping tool 100 includes a trigger on the bottom handle 114 configured to control the operation of the sealing assembly 160 (i.e., when depressed by a user, the trigger initiates the sealing operations of the strapping tool 100). In the illustrative embodiment, the control system of the strapping tool 100 further comprises a control board in a frame 108*c* for performing the central processing operations for the control of the strapping tool 100.

Now, the sealing operation of the strapping tool 100 of the illustrative embodiment will now be described. Initially, a piece of strapping (i.e., a piece of steel strapping) of one of a number of sizes is looped around a package or bundle that requires the restraint. Then, the user threads a first free end of the strapping through a seal member or banding clip. After which, the user bends the first free end of the strapping back so that it is not able to be pulled out of the seal member. Next, the user inserts the second free end of the strapping through the seal member so that a continuous loop is formed around the bundle. Then, the strapping and seal member are inserted into the strapping tool 100. Once the seal member is in the correct position, and tension has been applied to the strapping, the trigger on the bottom handle 114 is depressed by the user so that the sealing teeth of the sealing jaw members 164, 166 notch the metal seal member or banding clip. The notched seal member ensures that the strapping around the bundle does not release its tension.

Figure 12A:
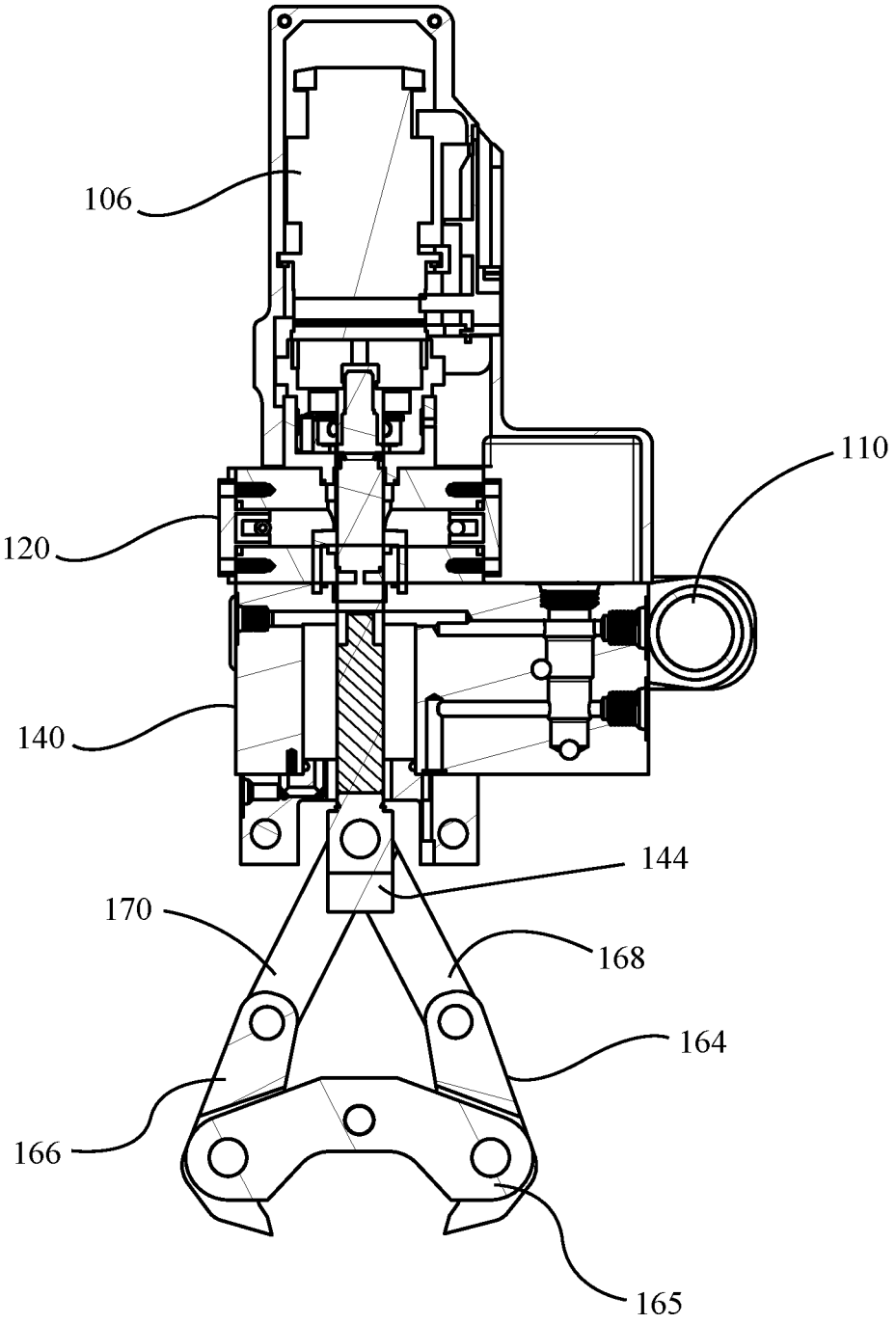
FIG. 12*a* is a sectional view cut through the hydraulic assembly and sealing assembly of the strapping tool of FIG. 1, wherein the jaws of the sealing assembly are shown in an open position.
Figure 12B:
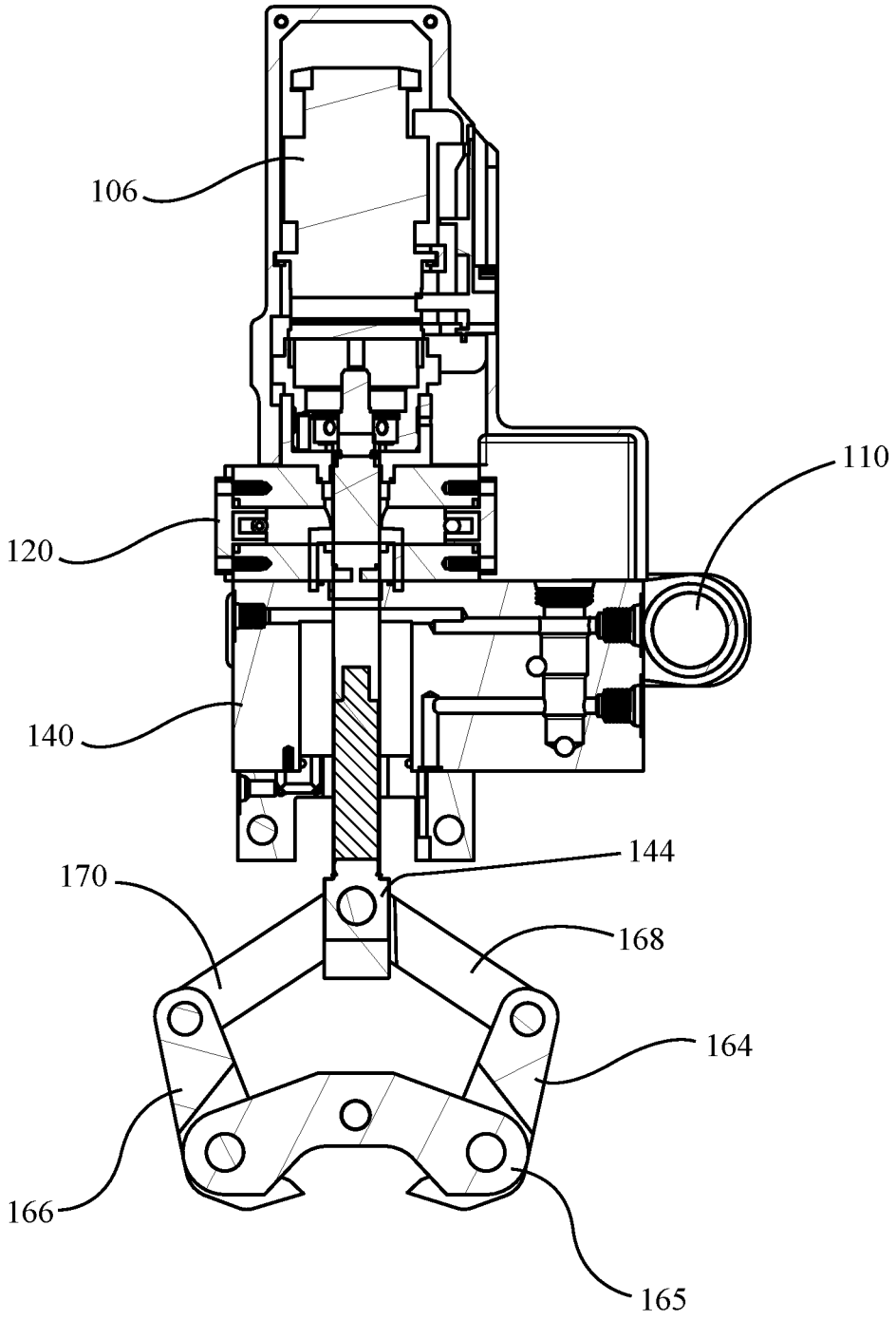
FIG. 12*b* is another sectional view of the hydraulic assembly and sealing assembly similar to the sectional view of FIG. 12*a*, wherein the jaws of the sealing assembly are shown in an intermediate position.
Figure 12C:
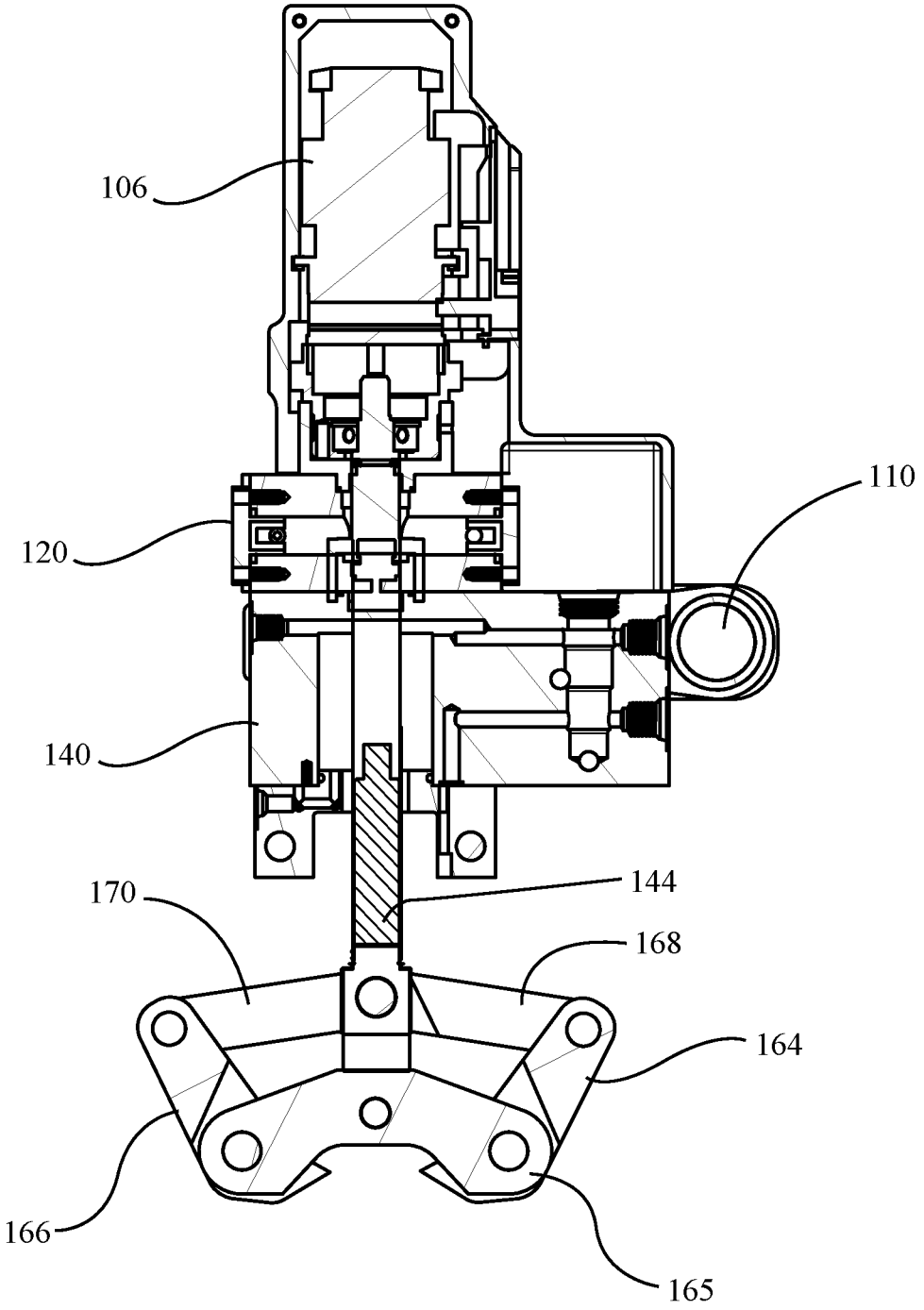
FIG. 12*c* is another sectional view of the hydraulic assembly and sealing assembly similar to the sectional view of FIG. 12*a*, wherein the jaws of the sealing assembly are shown in a fully crimped position.

FIGS. 12*a*-12*c* illustrate the full crimp cycle. The beginning of the crimp cycle is shown in FIG. 12*a*, while the end of the crimp cycle is shown in FIG. 12*c*. FIG. 12*c* illustrates the position of the sealing jaw members 164, 166 when the seal member is fully crimped, and the sensor that senses the arm position instructs the solenoid 116 to reverse flow and the jaw members 164, 166 to open and reset themselves for another cycle. As such, the fluid flow depicted in FIG. 11 occurs after the jaw positions depicted in FIG. 12*c*.

It is readily apparent that the aforedescribed strapping tool 100 offer numerous advantages. First, the strapping tool 100 is able to be conveniently used for virtually any application where other power sources are unavailable. Secondly, the strapping tool 100 utilizes hydraulics so as to result in a tool that is both lightweight and very powerful. Thirdly, the strapping tool 100, by virtue of being hydraulic, includes many moving parts that are self-lubricated.

The following is a list of reference characters that are utilized in the drawings of this application together with the components that they are used to represent:

100 Battery-Powered Hydraulic Crimping Tool For Steel Banding
102 Bottom Cover
104 Battery
106 Motor
**108*a*** Top Motor Housing
**108*b*** Electronic Motor Driver
**108*c*** Control Electronics in a Mounting Frame
**108*d*** Bottom Motor Housing
109 Battery-Powered Motor Assembly
110 Tank Body
111 Reservoir Piston
112 Tank Handle
113 Compression Spring
114 Bottom Handle
115 Valve Coil
116 Directional Valve
117 Pressure Relief Valve
118 Tank Reservoir
120 Pump
122 Inlet Hydraulic Check Valve
124 Outlet Hydraulic Check Valve
130 Hydraulic Assembly
140 Valve Cycle Block
142 Cylinder Shaft Wear Ring
143 Main Piston

144 Cylinder Rod or Shaft
146 Cylinder Cap
148 Outlet Check Valve Cavity
150 Inlet Check Valve Cavity
151 Ball Return Spring
152 Shaft Seal Drain Connection
154 Shaft
160 Sealing Assembly
162 Outer Crimp Head Plate
164 Left Jaw
165 Center Notcher
166 Right Jaw
168 Right Outer Links
170 Left Outer Links
200 Pump Rotor
201 Press-Fit Drill Bushing Top
202 Press-Fit Drill Bushing Bottom
203 Press-Fit Drill Bushing Left
204 Press-Fit Drill Bushing Right
205 Pump Balls
206 Pump Balls
208 Parabolic Indentation in Pump Rotor
210 Endcap
212 Socket Headcap Screw
214 Sealing O-Ring for Threaded Hex Socket Plug
216 Zero Leak High Pressure Steel Threaded Hex Socket Plug
217 Flow Arrow Denoting Hydraulic Fluid Flow in Pump
218 Flow Arrow Denoting Hydraulic Fluid Flow in Pump
220 Inboard Shaft Bearing
222 Inboard Shaft Bearing
224 Outboard Shaft Bearing
226 Outboard Shaft Bearing
228 Rotary Shaft Seal
230 Motor Collar
250 Hydraulic Cylinder Chamber
252 Rod End Hydraulic Cylinder Connection
254 Piston End Hydraulic Cylinder Connection Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A pump, comprising:

a pump rotor, the pump rotor including at least one indentation and at least one protrusion extending radially outward from the pump rotor beyond the at least one indentation; and a plurality of balls displaced by the pump rotor, the plurality of balls configured to displace a fluid in the pump;

wherein the pump contains no linkage members and no piston other than the plurality of balls; and wherein the pump rotor pushes the plurality of balls outwardly from a center of the pump, the at least one indentation and the at least one protrusion of the pump rotor successively engaging one or more balls of the plurality of balls during rotation of the pump rotor, the one or more balls of the plurality of balls being disposed radially outward from the center of the pump by a first distance when the at least one indentation engages the one or more balls of the plurality of balls, the one or more balls of the plurality of balls being disposed radially outward from the center of the pump by a second distance when the at least one protrusion engages the one or more balls of the plurality of balls, and the second distance being greater than the first distance.

2. The pump according to claim 1, wherein the plurality of balls displaced by the pump rotor include two balls in series that are displaced by the pump rotor; and wherein the pump further comprises a sleeve for tightly receiving the two balls, the two balls resulting in less leakage than a single ball.

3. The pump according to claim 1, wherein the pump further comprises a spring for creating a fluid force that returns the plurality of balls inwardly towards the center of the pump.

4. The pump according to claim 1, wherein the at least one indentation in the pump rotor comprises at least one parabolic indentation.

5. The pump according to claim 1, wherein the at least one indentation in the pump rotor comprises a plurality of indentations, and the at least one protrusion in the pump rotor comprises a plurality of protrusions, each of the plurality of indentations being spaced apart from one another about a circumference of the pump rotor by a respective one of the plurality of protrusions.

6. The pump according to claim 1, wherein the pump is provided as a part of a hydraulic assembly, the hydraulic assembly comprising a directional valve for allowing a reversal of a flow direction of the fluid in the hydraulic assembly.

7. The pump according to claim 6, wherein the directional valve is disposed in a manifold block of the hydraulic assembly.

8. The pump according to claim 7, wherein the manifold block of the hydraulic assembly further comprises a pressure relief valve for limiting a pressure of the fluid in the manifold block.

9. The pump according to claim 7, wherein the manifold block of the hydraulic assembly further comprises a hydraulic cylinder for providing an output force to drive an external assembly powered by the pump.

10. The pump according to claim 6, wherein the hydraulic assembly further comprises a spring-loaded hydraulic tank with an isolation piston that allows an external assembly powered by the pump to be used in a plurality of different orientations without being dependent on gravity.

* * * * *